US006199640B1

(12) United States Patent
Hecht

(10) Patent No.: US 6,199,640 B1
(45) Date of Patent: Mar. 13, 2001

(54) ELECTRIC MACHINE TOOL

(75) Inventor: Joachim Hecht, Magstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/242,599

(22) PCT Filed: May 6, 1998

(86) PCT No.: PCT/DE98/01247

§ 371 Date: May 6, 1999

§ 102(e) Date: May 6, 1999

(87) PCT Pub. No.: WO98/58774

PCT Pub. Date: Dec. 30, 1998

(30) Foreign Application Priority Data

Jun. 21, 1997 (DE) ..... 197 26 383

(51) Int. Cl.[7] ..... B25D 11/00
(52) U.S. Cl. ..... 173/48; 173/109; 173/205
(58) Field of Search ..... 173/48, 104, 109, 173/110, 111, 114, 205

(56) References Cited

U.S. PATENT DOCUMENTS 5,366,025 * 11/1994 Dutschk et al. ..... 173/48
5,427,188 * 6/1995 Fisher ..... 173/205
5,449,044 * 9/1995 Phillips ..... 173/205
5,513,709 * 5/1996 Fisher ..... 173/205
5,601,149 * 2/1997 Kawasaki et al. ..... 173/109

FOREIGN PATENT DOCUMENTS

2820125A * 11/1979 (DE) .
41 21 279 A1 1/1993 (DE) .

* cited by examiner

*Primary Examiner*—Scott A. Smith
(74) *Attorney, Agent, or Firm*—Michael J. Striker

(57) ABSTRACT

An electric machine tool for tools which operate by percussion, the electric machine tool having a machine housing; a rotatingly drivable work spindle seated in the machine housing; a tool receiver provided for receiving a tool and driven by the work spindle; a mechanical striking mechanism having a beater accelerated in an axial direction and actuating a shaft of the tool in the axial direction by blows; a driver unit which derives an acceleration of the beater from rotational movement, the driver unit having an axially displaceably arranged scanning member which rotates synchronously with the work spindle; two circular-shaped curved paths which guide the scanning member and are fixed in the housing, said circular-shaped curved paths having elevations and depressions, each of the elevations pointing in an axial direction of the work spindle in a direction of the scanning member.

20 Claims, 2 Drawing Sheets

ELECTRIC MACHINE TOOL

BACKGROUND OF THE INVENTION

The invention relates to an electric machine tool for tools which operate by rotation and/or percussion, such as a drill and/or riveting hammer or impact drilling machine.

In connection with a known drill and/or riveting hammer of this type (DE 41 21 279 A1), the drive unit comprises an eccentric seated on a gear shaft, which drives the work spindle via a gear wheel and, via a needle bearing, receives a coupling sleeve having an opening, as well as an elastically yielding driver member, which is seated, tiltable around an axis oriented transversely in relation to the gear shaft, in the machine housing. The driver member has a lever extending away from the axis toward the coupling sleeve, which engages the opening in the latter, and a two-legged hoop extending away from the axis, which is closed on its free end in a loop-like manner and is hinged with play between two collars formed on the beater. The beater is received with displacement play in the hollowly embodied drive spindle, wherein an inserted O-ring acts as a damper on the beater and prevents it from being displaced on its own. A header or a riveting bolt has been inserted between the tool shaft and the beater.

During operation, the driver member is driven via the eccentric in a back-and-forth movement, wherein only the vertical excursions of the eccentric are transmitted to the lever, while the transverse movements of the anchor sleeve do not reach the lever because of the opening, which is widened in this direction. Accordingly, the driver member performs a back-and-forth movement around its axis. At the moment of the impact of the beater on the header, and therefore on the tool, the driver member is at dead center on the tool side. Following the strong impact, the beater is reflected and flies backward toward the hoop of the driver member, which also moves backward. When the striking mechanism is well adjusted, the front collar touches the hoop of the driver member only slightly, or not at all. After passage through dead center on the motor side, the driver member again comes into contact with the front collar of the beater. Because of the kinetic energy of the beater, the hoop is bent backward in the process. Thus, the energy still stemming from the recoil of the beater is transferred to the elastic driver member and stored therein as spring energy. In the subsequent forward movement of the hoop, the latter accelerates the beater in the direction toward the tool, both because of the forward movement of the driver member and because of the backward springing hoop, wherein as a rule the beater attains higher velocities than the driving hoop. This leads to the separation of the beater from the driver member. The beater then flies freely over a defined distance, until another impact on the header and the tool takes place.

SUMMARY OF THE INVENTION

It is therefore an object of the present invention to provide an electric machine tool which avoids the disadvantages of the prior art.

In keeping with these objects in the inventive electric machine tool the driver unit has a scanning member which rotates synchronously with the work spindle, is axially displaceably arranged, and is guided with axial plate between two circular-shaped curved paths, which are arranged fixed against relative twisting in respect to the work spindle and have elevations and depressions pointing in the axial direction of the work spindle.

The electric machine tool has the advantage, that because of the mechanical striking mechanism constructed in accordance with the invention it is possible to omit a gear shaft and therefore to achieve greater spindle rpm. By means of the selection of the axial elevations and depressions provided on the curved paths, a corresponding number of beats per spindle revolution is achieved. By means of the striking mechanism in accordance with the invention it is possible to produce an electric machine tool with the emphasis on small tool diameters in a very cost-efficient manner, wherein the lubrication outlay is very small.

In accordance with a preferred embodiment of the invention, the elevations and depressions of the curved paths, which extend parallel with the axial direction of the work spindle, are constituted by several periods of a sine-like curve, wherein the two curved paths extend parallel with or offset from each other. Three or five periods of a sine curve per curved path are preferred.

In accordance with an advantageous embodiment of the invention, the spring-loaded actuators are designed as contact springs, which can be simply and cost-effectively manufactured and installed.

BRIEF DESCRIPTION OF THE DRAWINGS

The invention will be explained in greater detail in the following description by means of exemplary embodiments represented in the drawings. Shown in a partially schematic representation are in.

DESCRIPTION OF THE PREFERRED EMBODIMENTS

Figure 1:
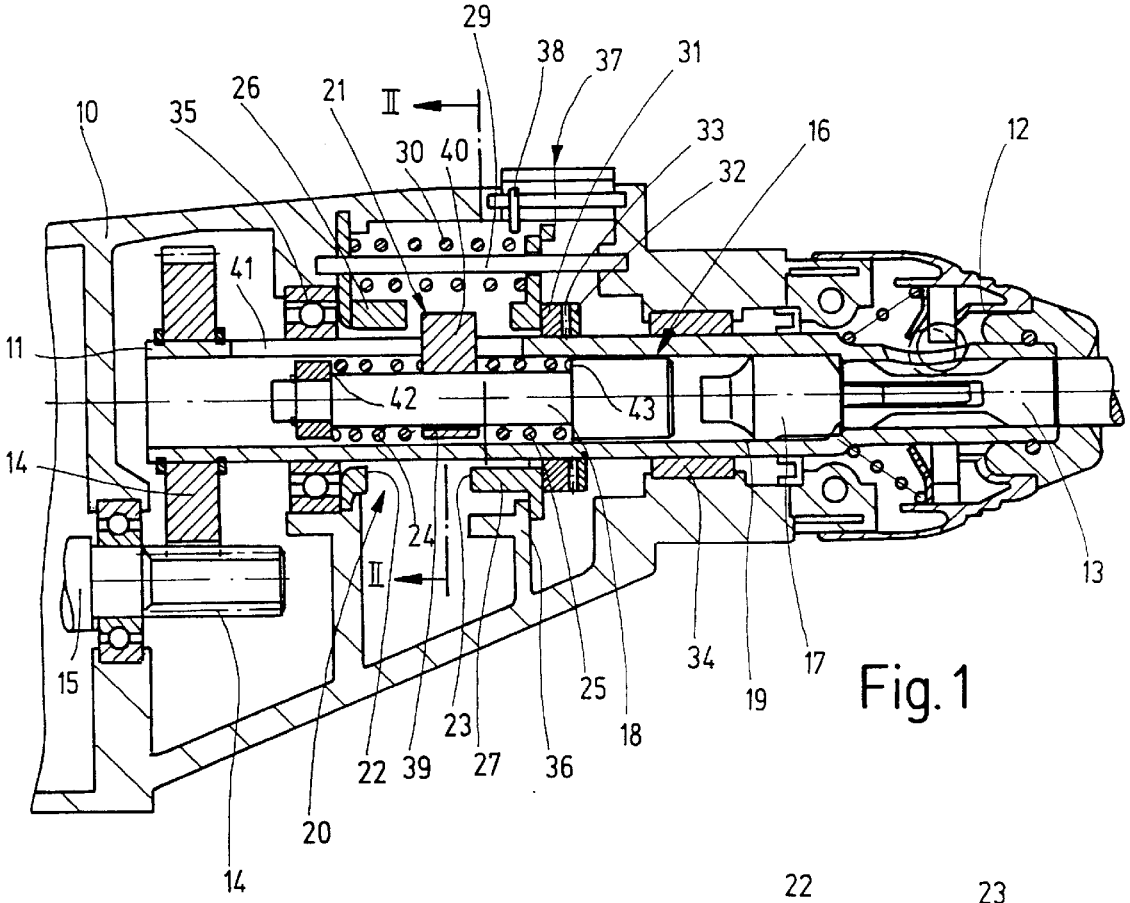
FIG. 1, in a partial view a longitudinal section of a drill hammer for selective drilling or impact drilling, FIG. 2, in a partial view a section along the line II—II in FIG. 1, FIG. 3, in a partial view a developed view of two curved paths in the striking mechanism of the drill hammer in FIG. 1, FIGS. 4 to 7 in respectively partial views a modified striking mechanism in accordance with further exemplary embodiments.
Figure 2:
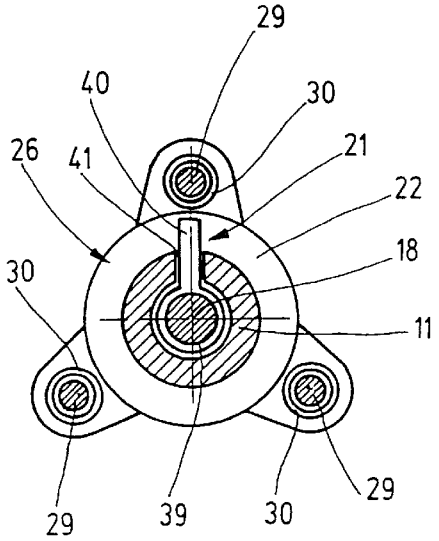

The drilling hammer, represented in a partial view in longitudinal section in FIG. 1 as an exemplary embodiment of a general, preferably manually guided electric machine tool with a tool, which operates rotatingly and/or by impact, has a housing 10 and a sleeve-shaped work spindle 11, also called a spindle sleeve, which is seated rotatingly and axially displaceably in the housing 10, as well as an electric motor, not represented here, for the rotary drive of the work spindle 11. A tool receiver 12 is formed on the front end of the work spindle 11, in which a shaft 13 of a tool is received, fixed against relative rotation and limitedly axially displaceable. The drive spindle 11 is caused to rotate by means of a gear wheel 14, which is seated, fixed against relative rotation, on the spindle end of the work spindle facing away from the tool receiver 12 and meshes with a drive pinion 14 formed on the shaft end of a driveshaft 15 seated in the housing 10. The driveshaft 15 is connected by means of a gear, not represented here, with the power take-off shaft of the electric motor, or it itself constitutes the power take-off shaft.

A mechanical striking mechanism 16 is provided for the impact drilling operation, which has a beater 18, which is accelerated in its axial direction and impacts via a striking pin or header 17 on the shaft 13 of the tool held in the tool receiver 12, as well as a driver unit 20, which derives the acceleration of the beater 18 from a rotary movement of the work spindle 11. The beater 18 and the header 17 are received with play and axially displaceably in the sleeve-shaped drive spindle 11. The displacement movement of the header 17 is limited in the direction toward the beater 18 by a snap ring 19 inserted into the work spindle 11, and in the direction toward the tool receiver 12 by the front end of the shaft 13.

Figure 3:
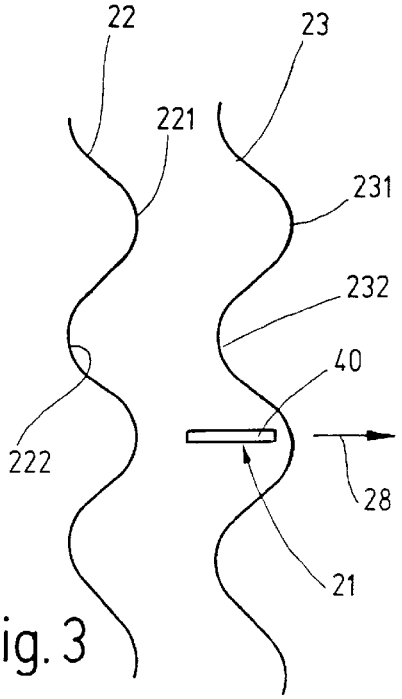

The driver unit 20 comprises a scanning member 21, which rotates synchronously with the work spindle 11, is arranged axially displaceable, and is guided with axial play between two parallel ring-shaped curved paths 22, 23, which are arranged coaxially with the work spindle 11 in a manner fixed against relative twisting in the housing 10, as well as two spring-loaded actuators, which are operative in the displacement path of the beater 18, act in opposite directions from each other and can be directly or indirectly tensed by the scanning member 21, wherein the spring-loaded actuators are preferably embodied as contact springs 24, 25. A developed view of the curved paths 22, 23 is represented in a partial view in FIG. 3, wherein the arrow 28 in FIG. 3 lies in the axial direction of the work spindle 11 and points toward the tool receiver 12. As can be clearly seen, the curved paths 22 have elevations 221, or respectively 231, and depressions 222, or respectively 223, which point in the axial direction of the work spindle 11. In the case of the example, the elevations 221, or respectively 231, and depressions 222, or respectively 223, are represented by a sine curve, wherein several periods of a sine curve are present over the circumference of the curved paths 22, 23. Three or five periods are preferably provided, so that therefore three, or respectively five, elevations 221, or respectively 231, and three, or respectively five depressions 222, or respectively 223, are present on each curved path 22 or 23. The number of the elevations and depressions, which are co-linear in the axial direction, depends on the desired number of impacts on the shaft 13 of the tool during one revolution of the work spindle 11.

The curved paths 22 and 23 are respectively formed on a cam disk 26, or respectively 27. The cam disk 26 is rigidly fixed in the housing 10. The cam disk 27 is displaceably guided on preferably three bolts 29, arranged on a graduated circle which is coaxial with the work spindle 11, and are offset in respect to each other by a circumferential angle of 120°. The bolts 29 are clamped in place in the machine housing 10 and each receives a contact spring 30, which is supported between the two cam disks 26, 27. By the action of the contact springs 30, the cam disk 27 rests against an axial bearing 33, which is axially non-displaceably fixed in place on the work spindle 11 by means of two disks 31, 33. The displacement mobility of the cam disk 27 is used for switching the striking mechanism 16 on or off. If the operator of the drill hammer pushes the tool clamped in the tool receiver 12 against a work surface, the tool is displaced into the tool receiver 12 over a limited displacement distance. The displacement movement of the tool is transferred by the shaft 13 to the header 17 which, via the snap ring 19, displaces the work spindle 11, which is seated in the housing 10 by means of a sliding bearing 34 and a roller bearing 35, sufficiently far so that the cam disk 27 touches a limit stop 36 formed on the housing 10. In this operating position represented in FIG. 1, the striking mechanism 16 is switched on and the scanning member 21 is conducted between the two curved paths 22, 23 on the cam disks 26, 27. If the tool is lifted off the work surface, the contact springs 30 push the cam disk 27 toward the left in FIG. 1, wherein the cam disk 27 pushes the work spindle 11 back again via the axial bearing 33. In the process the distance between the two curved paths 22, 23 is increased far enough, so that the scanning member 21 freely turns between the two curved paths 22, 23 without coming into contact with them. The striking mechanism 16 is turned off.

The striking mechanism 16 must be completely shut off for drilling operations. To this end, a manually operated shut-off member 37 in the form of a locking handle, which can be rotated by 180° and into which a set pin 38 has been eccentrically placed, is arranged on the machine housing 10. By turning the shut-off member 37 by 180°, the set pin 38 pivots into the displacement path of the cam disk 27 and is placed immediately in front of the cam disk 27 in the base position of the cam disk 27 which the latter assumes under the restoring force of the contact springs 30 when the tool is not in operation. A displacement movement of the cam disk 27 is blocked by means of this, the striking mechanism 16 is turned off and the drill hammer operates as a drill with the tool only turning.

In the exemplary embodiment of the driver unit 20 represented in FIG. 1, the scanning member 21 is seated with play with an annular element 39 on the beater 18 and extends with a scanning finger 40, which projects radially from the annular element 39, through an axial slit 41 in the spindle sleeve 11 as far as the curved paths 22, 23 on the two cam disks 26, 27. The scanning finger 40 is also indicated in the developed view of the curved tracks 22, 23 in FIG. 3. The two contact springs 24, 25 of the driver unit 20 have been pushed on the beater 18 and are supported on the one side on the front faces of the annular element 39, which face away from each other in the axial direction, and on the other side on radial shoulders 42, 43 formed on the beater 18.

During the operation of the striking mechanism 16, with each elevation 221 the curved path 22 accelerates the beater 18 in the direction toward the header 17, where it impacts on the header 17 and through it exerts a blow on the front of the shaft 13 of the tool. When the cam disk 27 rests against the limit stop 36 on the housing 10, the parallel distance of the two curved paths 22, 23, and the contact springs 24, 25 are matched to each other in such a way that the scanning finger 40 of the scanning member 20 is uncoupled to a large extent from the curved paths 22, 23 when the beater 18 impacts on the header 17. After the impact on the header 17, the beater 18 is reflected and flies backward in the direction toward the depression 222 of the curved path 22. When the striking mechanism is well adjusted, the scanning finger 40 touches the depression 232 of the curved path 23 only slightly or not at all. It can possibly be necessary to offset the curved paths 22, 23 in respect to each other in the circumferential direction for adjusting the striking mechanism. After passing through the dead center of the curved path 22 at the lowest point of the depression 222, the scanning finger 40 again touches the curved path 22. Because of the kinetic energy of the beater 18, the beater 18 is displaced against the contact spring 25 in the direction toward the scanning member 21 and is cocked by this, so that the kinetic energy of the beater 18 is converted into spring tension. Thereafter the beater 18 is accelerated in the forward direction by this energy and the following elevation 221 of the curved path 22, and the described process is repeated.

Figure 4:
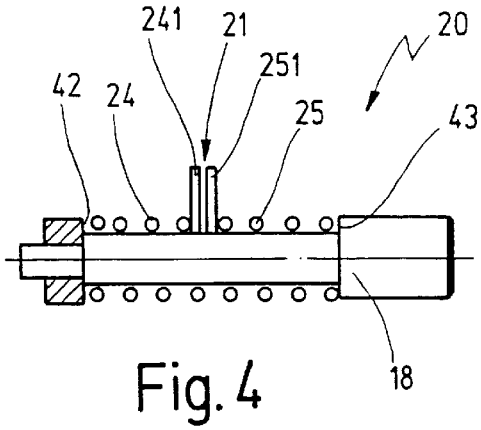

In the modified driver unit 20, which is represented in FIG. 4 in a partial view, the scanning member 21 is constituted by the abutting spring ends 241 and 251, which are radially bent outward. A separate component with an annular element 39 and a scanning finger 40 is omitted. After assembly, the two spring ends 241, 251, which are firmly connected with each other, project through the axial slit 41 in the spindle sleeve or drive spindle 11 and are guided between the two curved paths 22, 23 on the cam disks 26, 27 in the same way as described.

Figure 5:
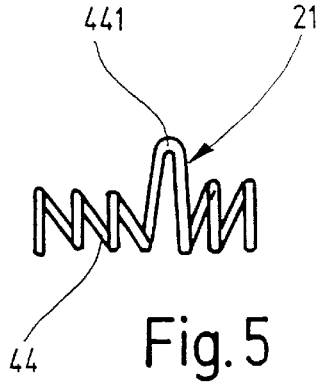

By means of a sketch drawn in FIG. 5 it is indicated that the two adjoining spring ends can also be connected in one piece with each other. In that case the two contact springs 24, 25 constitute a one-piece contact spring 44 with a radially projecting spring bend 441, which passes through the axial slit 41 in the spindle sleeve or drive spindle 11 and is guided between the curved paths 22, 23 as the scanning member 21.

Figure 6:
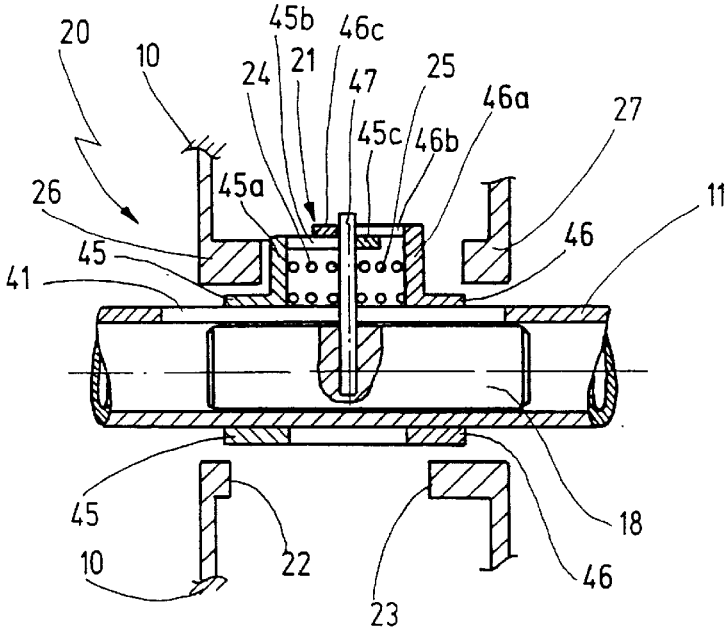

The driver unit 20, represented in a partial view in longitudinal section in FIG. 6 has been modified in respect to the above described driver unit 20 to the extent that the contact springs 24, 25 are arranged outside of the spindle sleeve or drive spindle 11. The scanning member 21 has two slide rings 45, 46, which are seated with play on the spindle sleeve 11 and on each of which a radially projecting hollow scanning protrusion 45*a*, 46*a* is formed as one piece with them. A connecting pin 47, which has been conducted through the insertion slit 41 in the spindle sleeve 11 and is anchored on the beater 18, projects into the scanning protrusions 45*a*, 46*a*, which can be displaced in relation to each other. Axial holding slits 45*b*, 46*b* are located in the scanning protrusions 45*a*, 46*a*, through which the connecting pin 47 extends. The connecting pin 47 is placed, fixed against relative rotation, in the scanning protrusions 45*a*, 46*a*, but can be displaced in the axial direction by means of the slide rings 45, 46. The contact springs 24, 25 arranged in the interior of the scanning cams 45, 46 are supported on the one side on the inner wall of the scanning cams 45, 46, and on the other side on the connecting pin 47. The slide rings 45, 46 are acted upon by the tension force of the contact springs 24, 25, in a way so they are pushed apart, so that the connecting pin 47 comes to rest against the brackets 45*c*, 46*c* on the scanning protrusions 45*a*, 46*a*. The arrangement of the cam disks 26, 27 is made as in FIG. 1, so that the scanning cams 45, 46 are guided between the two cam paths 22, 23.

Figure 7:
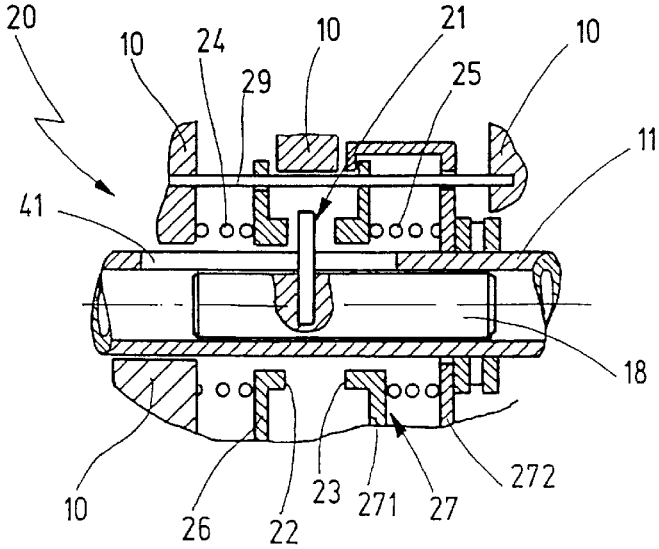

In the modified driver unit 20 represented in a partial view in longitudinal section in FIG. 7, the cam disk 26 carrying the curved track 21 is also designed to be axially displaceable and is guided on the bolts 29 in an axially displaceable manner. Transversely to its axial direction, the cam disk 27 is divided into a disk element 271 carrying the curved track 23 and a disk element 271 supported on the axial bearing 33 fixed in place on the spindle sleeve or drive spindle 11. The scanning member 21 is rigidly connected with the beater 18 and projects through the axial section 41 in the spindle sleeve 11 and again is guided between the two curved paths 22, 23. The two contact springs 24, 25 coaxially surround the spindle sleeve 11, while the contact spring 24 is supported between the housing 10 and the cam disk 26, and the contact spring 25 between the two disk elements 271 and 272 of the cam disk 27.

The functioning of the modified driver unit 20 in accordance with FIGS. 6 and 7 is the same as that of the driver unit 20 in FIG. 1, so that in this respect reference is made to the description there.

What is claimed is:

1. An electric machine tool for tools which operate by percussion, the electric machine tool having a machine housing; a rotatingly drivable work spindle seated in said machine housing; a tool receiver provided for receiving a tool and driven by said work spindle; a mechanical striking mechanism having a beater accelerated in an axial direction and actuating a shaft of the tool in the axial direction by means of blows; a driver unit which derives an acceleration of said beater from rotational movement, said driver unit having an axially displaceably arranged scanning member which rotates synchronously with said work spindle; two circular-shaped curved paths which guide said scanning member and are fixed in said housing, said circular-shaped curved paths having elevations and depressions, each of said elevations pointing in an axial direction of said work spindle in a direction of said scanning member.

2. An electric machine tool as defined in claim 1, wherein said elevations and depressions are formed by several periods of a sine-like curve.

3. An electric machine tool as defined in claim 2, wherein said elevations and depressions are formed by periods of a sine-like curve selected from the group consisting of three periods and five periods.

4. An electric machine tool for tools which operate by percussion, the electric machine tool having a machine housing; a rotatingly drivable work spindle seated in said machine housing; a tool receiver provided for receiving a tool and driven by said work spindle; a mechanical striking mechanism having a beater accelerated in an axial direction and actuating a shaft of the tool in the axial direction by means of blows; a driver unit which derives an acceleration of said beater from rotational movement, said driver unit having an axially displaceably arranged scanning member which rotates synchronously with said work spindle; two circular-shaped curved paths which guide said scanning member and are fixed in said housing, said circular-shaped curved paths having elevations and depressions, pointing in an axial direction of said work spindle in a direction of said scanning member, said driver unit having two spring-loaded actuators which are effective in a displacement path of said beater and act in opposite directions in respect to each other, said spring-loaded actuators being tensioned by said scanning member.

5. An electric machine tool as defined in claim 4, wherein a parallel distance of said curve paths with said elevations and depressions which are co-linear in said axial direction of said spindle, and offset spring-loaded actuators are matched to each other so that in a course of an impact of said beater on the shaft of the tool said scanning member is uncoupled during a subsequent return of said beater.

6. An electric machine tool as defined in claim 4, wherein said spring-loaded actuators are formed as contact springs.

7. An electric machine tool for tools which operate by percussion, the electric machine tool having a machine housing; a rotatingly drivable work spindle seated in said machine housing; a tool receiver provided for receiving a tool and driven by said work spindle; a mechanical striking mechanism having a beater accelerated in an axial direction and actuating a shaft of the tool in the axial direction by means of blows; a driver unit which derives an acceleration of said beater from rotational movement, said driver unit having an axially displaceably arranged scanning member which rotates synchronously with said work spindle; two circular-shaped curved paths which guide said scanning member and are fixed in said housing, said circular-shaped curved paths having elevations and depressions, pointing in an axial direction of said work spindle in a direction of said scanning member, said two curved paths being formed on each one of two circular cam disks which are fixed against relative rotation coaxially with said work spindle in said machine housing, one of said cam disks being axially displaceable in said machine housing for turning said striking mechanism on and off.

8. An electric machine tool as defined in claim 7, wherein said work spindle is axially displaceably seated in said machine housing, said displaceable cam disk being pressed by contact springs against an axial bearing fixed in place on said work spindle against relative rotation, and for limiting an axial displacement of said work spindle a limit stop is provided on a housing side on which said displaceable cam disk is fixed in a course of said axial displacement of said work spindle generated by a contact pressure of the tool.

9. An electric machine tool as defined in claim 8, wherein said displaceable cam disk slides on several parallel bolts arranged on a graduated circle which is coaxial with said work spindle and are offset at equal circumferential angles, said contact springs being received on said bolts.

10. An electric machine tool as defined in claim 8, and further comprising a manually operated shut-off member provided for said striking mechanism and having a limit stop which is pivotable into a displacement path of said displaceable cam disk and fixes said displaceable cam disk in its base position which it takes under a restoring force of said contact springs when the tool is not in operation.

11. An electric machine tool for tools which operate by percussion, the electric machine tool having a machine housing; a rotatingly drivable work spindle seated in said machine housing; a tool receiver provided for receiving a tool and driven by said work spindle; a mechanical striking mechanism having a beater accelerated in an axial direction and actuating a shaft of the tool in the axial direction by means of blows; a driver unit which derives an acceleration of said beater from rotational movement, said driver unit having an axially displaceably arranged scanning member which rotates synchronously with said work spindle; two circular-shaped curved paths which guide said scanning member and are fixed in said housing, said circular-shaped curved paths having elevations and depressions, pointing in an axial direction of said work spindle in a direction of said scanning member, said beater being placed axially displaceably into said work spindle formed as a spindle sleeve, said scanning member which is coupled with said beater projecting through an axial slit in said spindle sleeve; and further comprising a header which is displaceable in said spindle sleeve, is arranged between said beater and a shaft of the tool, and which for transmitting an axial tool displacement generated by a contact of the tool to said spindle sleeve is supported at its front end facing said beater on said spindle sleeve.

12. An electric machine tool as defined in claim 11, wherein said header is supported by a snap ring inserted into an inner wall of said spindle sleeve.

13. An electric machine tool as defined in claim 12, wherein said scanning member has a slide ring seated with play on said spindle sleeve and having radially projecting hollow scanning cams, said slide ring being connected with said beater fixed against relative rotation by a connecting element anchored on said beater and projecting through said slit of said spindle sleeve and also displaceable in respect to said connecting element in an axial direction; and two contact springs supported between sides of said connecting element facing away from each other and inner walls of said scanning cam.

14. An electric machine tool as defined in claim 12, wherein said scanning member is anchored in said beater, said displaceable cam disk being divided transversely in respect to the axial direction into a disk element carrying one of said curved paths and a disk element supported on an axial bearing of said spindle sleeve, the other cam disk being arranged coaxially displaceable in said machine housing; and one contact spring supported between disk elements of said one cam disk, and another contact spring supported between a back of the other cam disk which faces away from said curved path and said machine housing.

15. An electric machine tool as defined in claim 14, and further comprising a limit stop provided on a housing side for limiting the axial displacement of said spindle sleeve, and a pivotable limit stop of a shut-off member for shutting off said striking mechanism acting together with said disk element of said one cam disk which is supported on said axial bearing.

16. An electric machine tool as defined in claim 15, wherein said disk elements of said one cam disk and said other cam disk slide on several parallel bolts which are arranged on a graduated circle coaxial with said spindle sleeve and offset in relation to each other and clamped in place in said machine housing.

17. An electric machine tool as defined in claim 16, wherein said bolts are offset by equal circumferential angles.

18. An electric machine tool as defined in claim 11, wherein said scanning member is displaceably fitted on said beater and projects between said cam disks; and two contact springs are pushed on said beater and supported between respectively one of two sides of said scanning member facing away from each other in said axial direction, and respectively one of annular shoulders formed on said beater.

19. An electric machine tool as defined in claim 18, wherein said scanning member is formed by adjoining screen ends which are bent off outwardly with two spring ends rigidly connected with one another.

20. An electric machine tool as defined in claim 18, wherein said scanning member is formed by two contact springs connected of one piece with one another.

* * * * *